US005749796A

United States Patent [19]

Shimosaka et al.

[11] Patent Number: 5,749,796

[45] Date of Patent: May 12, 1998

[54] WOUND GOLF BALL

[75] Inventors: Hirotaka Shimosaka; Keisuke Ihara, both of Chichibu, Japan

[73] Assignee: Bridgestone Sports Co., Ltd., Tokyo, Japan

[21] Appl. No.: 847,999

[22] Filed: Apr. 22, 1997

Related U.S. Application Data

[62] Division of Ser. No. 510,275, Aug. 2, 1995, abandoned.

[30] Foreign Application Priority Data

Aug. 9, 1994 [JP] Japan ..... 6-208004

[51] Int. Cl.[6] ..... A63B 37/12

[52] U.S. Cl. ..... 473/365; 473/383

[58] Field of Search ..... 473/365, 377, 473/378, 383, 384

[56] References Cited

U.S. PATENT DOCUMENTS 5,181,717 1/1993 Donntag et al. ..... 473/605

5,286,532 2/1994 Yoshikawa et al. ..... 273/235 B X 5,445,387 8/1995 Maruko ..... 273/225 X 5,628,699 5/1997 Maruko et al. ..... 473/365 X

*Primary Examiner*—George J. Marlo

*Attorney, Agent, or Firm*—Sughrue, Mion, Zinn, Macpeak & Seas, PLLC

[57] ABSTRACT

In a wound golf ball comprising a center ball (1), thread rubber (2), and a cover, the cover consists of a first layer (3) on the wound center and a second layer (4) on the first layer. The first layer (3) is 0.5–3.0 mm thick. The second layer (4) is 10–300 μm thick. The second layer (4) may be formed by either (a) injection molding a resin composition to enclose the first layer (3) or (b) press molding a resin composition film wrapped around the first layer (3). Dimples may be embossed in the first layer (3) before the second layer (4) is formed thereon. Preferably, dimples are embossed after the second layer (4) is formed on the first layer (3). The ball affords improved spin and flying distance and is fully durable.

12 Claims, 2 Drawing Sheets

WOUND GOLF BALL

This is a Divisional of application Ser. No. 08/510,275 filed Aug. 2, 1995 now abandoned.

BACKGROUND OF THE INVENTION

1. Field of the Invention

This invention relates to a thread wound golf ball which is durable while affording satisfactory spin property and flying distance.

2. Prior Art

Thread wound golf balls are generally prepared by winding thread rubber on a center ball to form a wound core and enclosing the wound core in a cover. The cover has dual functions of protecting the wound core and controlling the playability features of the wound golf ball including spin, flying distance and durability. A number of proposals have been made on the cover. There is still a need to have a wound golf ball which is further improved in spin property, flying distance and durability.

SUMMARY OF THE INVENTION

An object of the present invention is to provide a wound golf ball which is improved in spin property, flying distance and durability by tailoring the cover.

The present invention relates to a thread wound golf ball having a center ball, thread rubber, and a cover. Around the cover which is also referred to as a first cover layer, a thin layer which is also referred to as a second cover layer is formed. The second cover layer is as thin as 300 μm or less. The resulting wound golf ball is improved in spin properties and affords a longer flying distance.

By forming a thin layer of ionomer resin or the like to a thickness of 300 μm or less as the second cover layer, the wound golf ball is not only improved in durability in that the cover is prevented from fracture even when topped with iron clubs, but also provides good repulsion or restitution and satisfactory spin properties when struck with the driver or the like.

Although conventional wound golf balls are coated on the cover surface with a paint film for protection, the provision of the second cover layer of up to 300 μm thick allows such paint spraying to be omitted. The paint coating is difficult to form to a uniform thickness. Since the paint coating is formed after dimple formation, the diameter and depth of dimples change from the original designed dimensions. Such a loss of dimple precision can affect aerodynamic and spin characteristics. Also variations in thickness of the paint coating can prevent the ball from exerting desired performance.

The second cover layer used in the present invention is a thin film of up to 300 μm which is substantially free of a variation in thickness and does not cause a loss of dimple precision. Since dimples can be formed after formation of the second cover layer, the wound golf ball can be manufactured exactly as designed with respect to configuration and performance. The second cover layer effectively protects the first cover layer or original cover, ensuring more durability than the conventional paint coating.

Since the second cover layer is as thin as 300 μm or less, it does not detract from the repulsion or restitution of the first cover layer, allowing the first cover layer to exert its own flying performance. In addition, the second cover layer is effective for improving spin properties as will be demonstrated in Examples.

According to the present invention, there is provided a wound golf ball comprising a center ball, thread rubber wound thereon, a first cover layer enclosing the wound center, and a second cover layer around the first cover layer having a thickness of up to 300 μm.

BEST MODE FOR CARRYING OUT THE INVENTION

Figure 1:
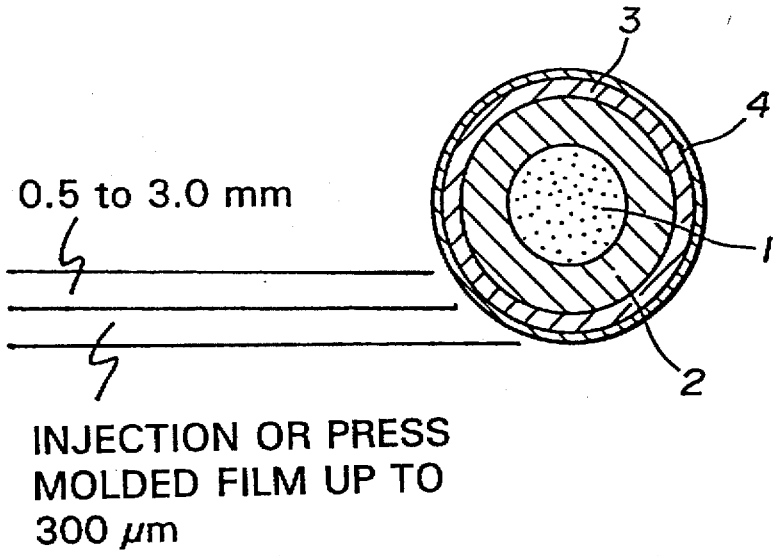
FIG. 1 is a schematic cross-sectional view of one exemplary wound golf ball.

Referring to FIG. 1, a wound golf ball is illustrated as comprising a spherical center ball 1. Thread rubber is wound on the center ball 1 to form a thread rubber layer 2, which is enclosed in a first cover layer 3. According to the invention, a second cover layer 4 encircles the first cover layer 3. Differently stated, the cover has a two layer structure consisting of the first or inner layer 3 and the second or outer layer 4.

The wound golf ball of the invention may have either a liquid center or a solid center as the center ball 1, which are both conventional.

The liquid center typically consists of a rubber or center bag filled with a liquid. The rubber or center bag may be formed of any well-known composition. Water is the preferred liquid. The fill liquid preferably has a specific gravity of at least 0.9, more preferably 1.0 to 1.5, most preferably 1.0 to 1.2. Fine powder, surfactant or the like may be added to water for adjusting the specific gravity. The fine powder used herein is one which consists of fine particles and is not dissolved in water. Typical examples are fillers such as barium sulfate, zinc oxide, and silica. The powder preferably has a mean particle size of 0.02 to 100 μm, especially 0.5 to 20 μm. The powder may be blended in an amount of 4 to 60% by weight, especially 10 to 50% by weight of the fill liquid. Exemplary surfactants are dodecylbenzenesulfonic acid and sodium dodecylbenzenesulfonate.

Also the solid center may be of a well-known polymer composition. The preferred base rubber is polybutadiene rubber crosslinked and cured with an unsaturated carboxylic acid or metal salt thereof, polybutadiene rubber crosslinked and cured with an unsaturated carboxylic acid ester, or polybutadiene rubber crosslinked and cured with a mixture of an unsaturated carboxylic acid or metal salt thereof and an unsaturated carboxylic acid ester. There may be blended other components such as zinc oxide, organic peroxide, and fillers.

The center ball preferably has an outer diameter of 24 to 30 mm and a weight of 10 to 23 g.

The type of thread rubber wound on the center ball and the winding technique may be conventional. The center ball is wrapped with thread rubber to form a wound core preferably having a diameter of 38 to 41 mm.

The first cover layer enclosing the wound core may be formed of conventional compositions used in prior art wound golf balls. More particularly, the first cover layer may be formed of a composition comprising a well-known cover resin such as ionomer resins and balata rubber and conventional amounts of optional additives including pigments such as titanium white and dispersants such as magnesium stearate. It is recommended for a good balance of spin and flying distance that the first cover layer has a Shore D hardness of 45 to 75, more preferably 55 to 70, most preferably 60 to 68. The first cover layer preferably has a thickness of 0.5 to 3.0 mm, especially 1.0 to 2.5 mm though the thickness is not limited to this range. The first cover layer would be less durable at a thickness below 0.5 mm and less repulsive at a thickness beyond 3.0 mm.

It is understood that although the first cover layer 3 is shown as a single layer in FIG. 1, it may have a multilayer structure including a plurality of plies.

The second cover layer 4 on the first cover layer 3 may be formed of a resin film of ionomer resins, urethane resins or the like. The hardness of the second cover layer may be equal to or higher or lower than the hardness of the first cover layer. When the hardness of the second cover layer is lower than the hardness of the first cover layer, improvements in spin properties are expectable. When the hardness of the second cover layer is higher than the hardness of the first cover layer, the ball becomes more durable.

The second cover layer has a thickness of up to 300 μm, preferably 10 to 200 μm, more preferably 50 to 150 μm. A thicker second cover layer will provide the ball with a too high spin rate and less repulsion.

The wound golf ball of the present invention is prepared, for example, by placing the wound core in a mold cavity, injection molding a resin composition for the first cover layer, and further injection molding a resin composition for the second cover layer. Alternatively, after a resin composition is injection molded around the wound core to form the first cover layer as above, a film formed from a resin composition for the second cover layer is wrapped around the first cover layer and press molded at 130° to 170° C. for about 3 to 10 minutes to form the second cover layer.

In the practice of the invention, dimples may be embossed in the first cover layer before the second cover layer is formed thereon. Preferably dimples are embossed after the second cover layer is formed on the first cover layer.

It is acceptable to form a paint coating on the second cover layer. However, since the second cover layer itself has the function of a paint coating as previously mentioned, a paint coating is not always necessary. Then the golf ball is complete after the second cover layer is formed.

The wound golf ball of the invention has a size and weight meeting the Golf Association Standards, that is, a diameter of at least 42.67 mm and a weight of up to 45.92 g.

There has been described a thread wound golf ball wherein a wound core is covered with a first cover layer which is, in turn, covered with a very thin second cover layer. The ball is not only improved in durability in that the cover is prevented from fracture due to the second cover layer even when topped with iron clubs, but also provides good repulsion and satisfactory spin properties due to the first cover layer when struck with the driver or the like.

EXAMPLE

Examples of the present invention are given below by way of illustration and not by way of limitation.

Examples 1–3

A liquid center was prepared by molding a natural rubber composition in a hemispherical mold cavity and vulcanizing it to form hollow hemispherical shells having a thickness of 2.2 mm and a hardness of 60 on JIS A scale. A pair of shells were mated to form a rubber bag which was filled with water containing 4% by weight of an anti-freeze agent. The center ball had an outer diameter of 28 mm and a weight of 17 g. The weight of the liquid was 6.1 g.

Thread rubber (polyisoprene) of 0.55 mm thick and 1.5 mm wide was wound on the center ball by a conventional winding technique to form a thread rubber layer of 5.2 mm thick. The resulting wound core had a weight of 34.4 g.

A cover composition was prepared by blending 100 parts by weight of a zinc ionomer resin with 5 parts by weight of titanium oxide and 0.3 parts by weight of magnesium stearate in a twin screw extruder. The cover composition was molded into hemispherical cups.

A pair of cups were mated so as to enclose the wound core therein and compression molded to form a first cover having a Shore D hardness of 63.

An ionomer resin having a Shore D hardness of 54 (Himilan 1855) was sheeted into films of 25 μm, 50 μm and 150 μm thick, from which hemispherical cups were formed.

A pair of cups of the same gage were mated so as to enclose the first cover-bearing core, placed in a vacuum packing machine, and heated at 120° C. for 30 seconds. The ball was transferred to an embossing mold where the ball was heat pressed at 160° C. and 120 kg/cm$^2$ for 5 minutes to emboss dimples. After deburring, a wound golf ball was complete.

Examples 1, 2 and 3 are the thus obtained golf balls having an outermost or second cover layer of 25 μm, 50 μm and 150 μm thick, respectively.

Comparative Example 1

A wound golf ball was prepared by enclosing the wound core in the first cover as in Example 1, but the second cover layer was omitted.

The wound golf balls of Examples 1–3 and Comparative Example 1 were tested by the following methods. The results are shown in Table 1 and FIG. 2.

Hardness

Hardness is expressed by a displacement of a wound golf ball when the load is changed from an initial load of 10 kg to a final load of 130 kg.

Spin

Test 1: A ball was swept with the sand wedge at a head speed of 30 m/s so as to fly a distance of about 60 m.

Test 2: A ball was hit with the sand wedge at a head speed of 27 m/s so as to fly a distance of about 55 m.

Test 3: A ball was hit with the sand wedge at a head speed of 20 m/s so as to fly a distance of about 20 m.

TABLE 1

| | Weight | Hardness | Diameter | Spin (rpm) | | |
|---|---|---|---|---|---|---|
| | (g) | (mm) | (mm) | Test 1 | Test 2 | Test 3 |
| E 1 | 44.45 | 3.82 | 42.73 | 5400 | 5490 | 4350 |
| E 2 | 44.33 | 3.63 | 42.67 | 6030 | 6040 | 4660 |
| E 3 | 44.43 | 3.61 | 42.67 | 6730 | 6510 | 4950 |
| CE1 | 44.41 | 3.52 | 42.77 | 3320 | 3080 | 2760 |

Figure 2:
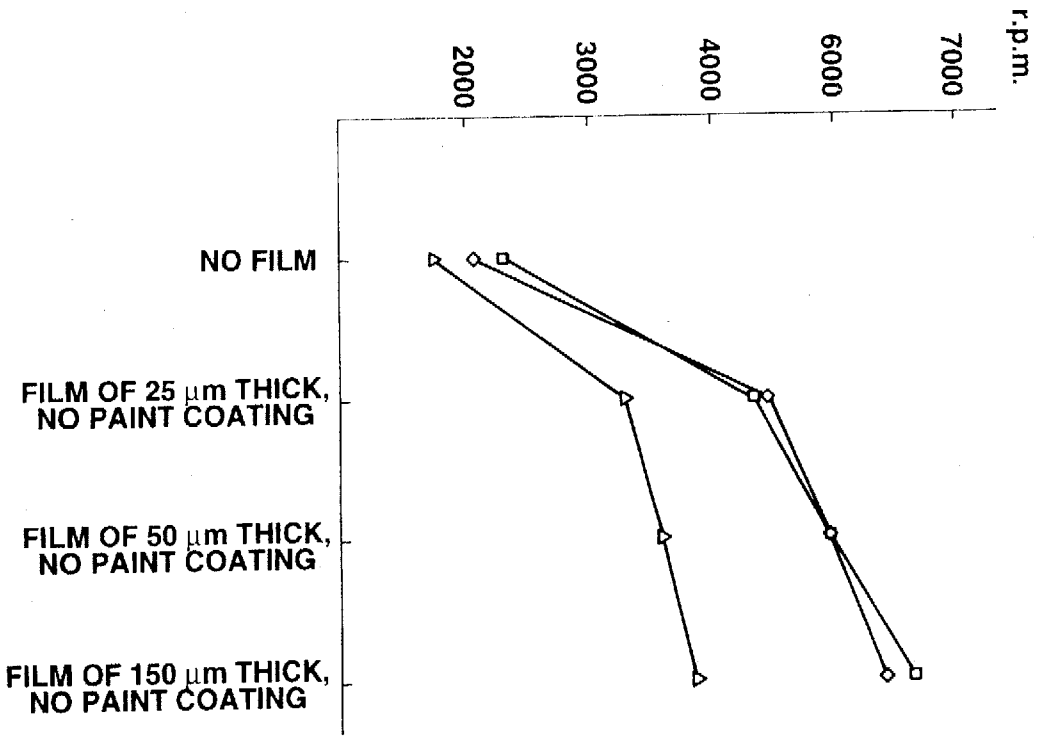
FIG. 2 is a graph showing the spin rate of balls having a second cover layer of different thickness.

It is evident from Table 1 and FIG. 2 that spin properties are improved by forming the second cover layer with a thickness of up to 300 μm. The golf balls of Examples were fully durable without a paint coating because the second cover layer protected the first cover layer.

Japanese Patent Application No. 208004/1994 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising a center ball, thread rubber wound thereon, a first cover layer enclosing the wound center, and a second cover layer comprising a resin composition and having a thickness of up to 300 μm enclosing the first cover layer, said second cover layer being formed by injection molding the resin composition to enclose the first cover layer.

2. The wound golf ball of claim 1 wherein dimples are embossed after the first cover layer is formed.

3. The wound golf ball of claim 1 wherein dimples are embossed after the second cover layer is formed.

4. The wound golf ball of claim 1, wherein the first cover layer has a thickness of 0.5 to 3.0 mm.

5. The wound golf ball of claim 1, wherein the second cover layer has a thickness of 10 to 300 μm.

6. The wound golf ball of claim 1, wherein the second cover layer has a thickness of 50 to 150 μm.

7. A wound golf ball comprising a center ball, thread rubber wound thereon, a first cover layer enclosing the wound center, and a second cover layer comprising a resin composition and having a thickness of up to 300 μm enclosing the first cover layer, said second cover layer being formed by wrapping a film formed from the resin composition to enclose the first cover layer, and press molding the film.

8. The wound golf ball of claim 4 wherein dimples are embossed after the first cover layer is formed.

9. The wound golf ball of claim 4 wherein dimples are embossed after the second cover layer is formed.

10. The wound golf ball of claim 7, wherein the first cover layer has a thickness of 0.5 to 3.0 mm.

11. The wound golf ball of claim 7, wherein the second cover layer has a thickness of 10 to 300 μm.

12. The wound golf ball of claim 7, wherein the second cover layer has a thickness of 50 to 150 μm.

* * * * *